US012680414B1

(12) United States Patent
Clery et al.

(10) Patent No.: US 12,680,414 B1
(45) Date of Patent: Jul. 14, 2026

(54) DOWNHOLE PACKER ASSEMBLY HAVING AN AUTO-RETRACTION MECHANISM

(71) Applicant: Schlumberger Technology Corporation, Sugar Land, TX (US)

(72) Inventors: Pierre Clery, Abbeville (FR); Stephane Metayer, Abbeville (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 19/015,997

(22) Filed: Jan. 10, 2025

(51) Int. Cl.
*E21B 33/127* (2006.01)

(52) U.S. Cl.
CPC ..... *E21B 33/1277* (2013.01)

(58) Field of Classification Search
CPC ..... E21B 33/1277; E21B 33/127; E21B 33/1243; E21B 33/1246; E21B 33/1272; E21B 33/1275
See application file for complete search history.

(56) References Cited

U.S. PATENT DOCUMENTS

| | | | |
|---|---|---|---|
| 7,422,071 B2 | 9/2008 | Wilkie et al. | |
| 7,806,177 B2 | 10/2010 | Bishop et al. | |
| 9,181,771 B2 | 11/2015 | Corre et al. | |
| 9,714,554 B1 | 7/2017 | Cook et al. | |
| 10,088,047 B2 | 10/2018 | Allen et al. | |
| 2014/0096979 A1* | 4/2014 | Corre | E21B 49/082 166/387 |

FOREIGN PATENT DOCUMENTS

| | | |
|---|---|---|
| CN | 206530313 A | 9/2017 |
| CN | 207795137 A | 8/2018 |
| CN | 111852388 A | 10/2020 |
| CN | 219197286 U | 6/2023 |
| CN | 117449797 A | 1/2024 |

* cited by examiner

*Primary Examiner* — Kristyn A Hall
(74) *Attorney, Agent, or Firm* — Jeffrey D. Frantz

(57) ABSTRACT

A downhole packer assembly may include an outer wall, an inflatable bladder, at least one coupling element, and at least one auto-retraction mechanism. The inflatable bladder may be configured to cause the outer wall to expand radially outwardly. The at least one coupling element may be mechanically coupled radially with the outer wall. The at least one auto-retraction mechanism may be configured to mechanically assist the outer wall to retract radially inwardly when the inflatable bladder is deflated from an inflated configuration toward a deflated configuration. The auto-retraction mechanism may include a chassis and a plurality of pistons, each piston having one end coupled to the chassis and another end coupled to a coupling element.

13 Claims, 6 Drawing Sheets

DOWNHOLE PACKER ASSEMBLY HAVING AN AUTO-RETRACTION MECHANISM

FIELD

The present disclosure relates to a subsurface operation in an oil and gas field. Particularly, the present disclosure relates to a downhole packer assembly having an auto-retraction mechanism.

BACKGROUND

For successful oil and gas exploration, information about subsurface formations that are penetrated by a wellbore is necessary. Measurements are essential to predicting the production capacity and production lifetime of a subsurface formation. Collection and sampling of underground fluids contained in subterranean formations is well-known. In petroleum exploration and recovery industries, for example, samples of formation fluids are collected and analyzed for various purposes, such as to determine the existence, composition and producibility of subterranean hydrocarbon fluid reservoirs. This aspect of the exploration and recovery process is crucial to developing exploitation strategies and has significant financial impact on expenditures and savings.

Samples of formation fluid, also known as reservoir fluid, are typically collected as early as possible in the life of a reservoir for analysis at the surface and, more particularly, in specialized laboratories. The information that such analysis provides is vital in planning and developing hydrocarbon reservoirs, as well as in assessment of the capacity and performance of a reservoir.

Sampling formation fluid from subterranean formations and conducting formation tests often includes one or more inflatable packer assemblies or packers (e.g. straddle packers) to hydraulically isolate or seal a section of a wellbore or borehole that penetrates a formation to be tested or sampled. Such inflatable packer assemblies typically include an inflatable bladder made from an elastomeric material that is reinforced with metal slats or cables. However, due to harsh conditions (e.g. high temperatures) within many boreholes, an elasticity and mechanical strength of the elastomeric material of the packer element may become significantly compromised. Thus, a packer may be inflated to seal against a portion of the borehole and may stay stuck to the portion of the borehole and/or retain a relatively large outside diameter after the inflation pressure has been released. In such cases, the outside diameter of the inflated packer may be large enough to prevent the downhole tool, to which it is attached, from being removed from the borehole, thereby resulting in costly well repair and/or tool recovery operations.

Additionally, in applications where an inflatable packer is used with a downhole tool deployed via a drill string, a packer element may inadvertently expand as a result of rotation and become wedged in the borehole. This may cause the packer to become damaged and/or may result in the tool becoming stuck in the borehole.

Therefore, a need exists to provide a downhole packer assembly in which a deflated configuration may be secured and/or in which a transition from an inflated configuration to the deflated configuration may be better controlled and secured.

SUMMARY

According to aspects of the present disclosure, a downhole packer assembly having an axis and comprising an outer wall (or outer sleeve); an inflatable bladder configured to cause the outer wall to expand radially outwardly, the inflatable bladder having a first diameter in a deflated configuration and a second diameter in an inflated configuration, the second diameter being greater than the first diameter; at least one coupling element mechanically coupled radially with the outer wall; at least one auto-retraction mechanism configured to mechanically assist the outer wall to retract radially inwardly when the inflatable bladder is deflated from the inflated configuration toward the deflated configuration, the auto-retraction mechanism comprising a chassis and a plurality of pistons, each piston having one end coupled to the chassis and another end coupled to a coupling element.

In the following, and unless otherwise specified, "coupling element" and "auto-retraction mechanism" should be understood as "at least one coupling element" and "at least one auto-retraction mechanism".

In the following, and unless otherwise specified, the axis of the downhole packer assembly define the axial direction. A radial direction is a direction perpendicular to the axis. A circumferential direction corresponds to the direction describing a ring around the axis. The adjectives "inner/inwardly/internal" and "outer/outward/external" are used in reference to the radial direction, so that "inner/inwardly/internal" (i.e. radially "inner/inwardly/internal") means is closer to the axis than "outer/outward/external" (i.e. radially "outer/outward/external").

The outer wall may have an annular shape surrounding the inflatable bladder. The outer wall may be a wall of the inflatable bladder, for example an outer wall of the inflatable bladder, or a wall distinct from a wall of the inflatable bladder. For example, the outer wall may be integral with the inflatable bladder, or may form a distinct layer, cooperating directly or indirectly with the inflatable bladder. Considered along the axis, the outer wall may surround all or part of the inflatable bladder. The outer wall is disposed radially outside the inflatable bladder. The outer wall may be made of material adapted to follow the deformation of the inflatable bladder during the transition between the deflated configuration and the inflated configuration. It is noted that both the inflatable bladder and the downhole packer assembly may have an inflated configuration and a deflated configuration, the inflatable bladder and the downhole packer assembly being simultaneously in the inflated configuration or in the deflated configuration.

The first and second diameters may be the inner maximum diameter on the inflatable bladder, respectively in the deflated and in the inflated configuration.

The coupling element may be any element enabling a mechanical coupling between the outer wall and a piston. For example, the coupling element may be a solid or hollow bar, a structural bar, a reinforcement bar, a flowline, etc. For example, the coupling element may at least in part be embedded within the outer wall. If the downhole packer assembly comprises several coupling elements, the coupling elements may be similar or distinct. For example, coupling elements of a first set of coupling elements may be of a first type, and coupling elements of a second set of coupling elements may be of a second type, distinct from the first type. If the downhole packer assembly comprises several auto-retraction mechanisms, the pistons of each auto-retraction mechanism may be coupled to coupling elements of the same type or of different type.

The pistons may be coupled to the chassis and/or to the coupling element via a ball point connection or a pivot connection. For example, the pistons extend perpendicularly to the axis, along a circumferential direction, and are each coupled to a coupling element via a pivot connection.

According to aspects of the present disclosure, the outer wall may have at least one drain, the downhole packer assembly may comprise two end pieces defining two axially opposed ends of the downhole packer assembly, the outer wall and the inflatable bladder being disposed axially between the two end pieces; and at least one of the at least one coupling element being a flowline in fluid communication with the at least one drain and with at least one of the end pieces.

In the following, and unless otherwise specified, "drain" and "flowline" should be understood as "at least one drain" and "at least one flowline".

The flowline may be straight (hollow) tube. The flowline may be stiff or rigid with respect to the inflatable bladder and/or the outer wall, i.e. the flowline may not deform or in acceptable tolerance in their elastic domain only, when the downhole packer assembly transits from the deflated configuration to the inflated configuration and vice versa. The flowline may be in fluid communication with a single end piece, or with the two end pieces.

For example, one or more of the coupling elements may be a flowline and the rest of the coupling element may be distinct from the flowlines. For example, the downhole packer assembly may comprise two auto-retraction mechanisms disposed on opposite axial sides of the inflatable bladder, each of the pistons of one of the auto-retraction mechanism being coupled to a flowline and the pistons of the other auto-retraction mechanism being coupled to coupling elements distinct from flowlines, for example an axial bar (e.g. solid bar).

According to aspects of the present disclosure, the downhole packer assembly may comprise two axially opposed mandrels defining axial ends of an inner chamber of the inflatable bladder, the chassis of the auto-retraction mechanism surrounding one mandrel of the axially opposed mandrels radially and being mechanically uncoupled with said mandrel.

The chassis may be fitted around a mandrel. The chassis may be free to rotate with respect to the mandrel. The chassis may be free to slide along the axis with respect to the mandrel. The auto-retraction mechanism may be mechanically coupled to coupling element only, via an end of each piston.

According to aspects of the present disclosure, the chassis may comprise at least one ring provided with a plurality of clevises, each clevis being coupled to at least one piston.

In the following, and unless otherwise specified, "ring", should be understood as "at least one ring".

Each piston may be coupled to a single clevis via a pivot connection, for example via a clevis pin.

According to aspect of the present disclosure, each piston may comprise a cylinder having a chamber and a rod slidingly received within the chamber and configured to move between an extended position and a retracted position, the rod having a diameter substantially equal to a diameter of the chamber.

The rod is configured to move with respect to the cylinder. "Substantially equal" should be understood as the diameter (or outer diameter) of the rod and the diameter (or inner diameter) of the chamber are set so that the rod is slidingly engaged within the chamber with a minimum radial gap. The rod may comprise a stem and an eye. The stem may be the part of the rod which is slidingly engaged within the chamber, and the diameter of the rod may be the diameter of the stem. The eye may be the part of the rod which is coupled to the coupling element or to the chassis. The cylinder may comprise an eye to be coupled to the chassis or to the coupling element, respectively. In other words, the piston may comprise a first eye at a first end, for example the eye of the cylinder, coupled to a first element among the chassis and the coupling element, and a second eye at a second end, for example the eye of the rod, coupled to a second element among the chassis and the coupling element.

According to aspects of the present disclosure, each piston may comprise a cylinder having a chamber, a rod slidingly received within the chamber and configured to move between an extended position and a retracted position, and a stop mechanism configured to limit extension of the rod to a predetermined length in the extended position, the stop mechanism comprising a sliding shaft received within an open sliding path arranged outside the chamber of the cylinder.

The sliding shaft may be parallel to the rod. The sliding shaft may move simultaneously and in the same direction, or in other words may move in concert, with the rod.

The open sliding path may be arranged on an outer portion of the cylinder. For example, the open sliding path may have a lateral opening, for example a lateral opening having an elongated or oblong shape, a main axis of which being parallel to the rod or to the shaft.

According to aspects of the present disclosure, the sliding shaft and the open sliding path may have complementary abutment surfaces configured to abut against each other in a sliding direction of the sliding shaft, the abutment surfaces being bevelled with respect to the sliding direction of the sliding shaft.

The abutment surfaces may be configured to cooperate in a form-fitting manner. The complementary abutment surfaces may be configured to abut against each other when the rod moves from the retracted position to the extended position and reaches the extended position. The distance between the two abutment surfaces in the retracted position of the rod may define the maximum stroke of the rod or the maximum extension length of the rod in the extended position.

According to aspects of the present disclosure, each piston may be a passive piston comprising a cylinder having a chamber and a rod slidingly received within the chamber and configured to move between an extended position and a retracted position, the chamber being pressurized at an atmospheric pressure when the rod is in the retracted position.

The atmospheric pressure is the pressure within the atmospheric pressure on Earth at sea level or the mean sea-level atmospheric pressure on Earth, which is approximately 101,325 Pa (1,013.25 hPa) or 14.696 psi.

According to aspects of the present disclosure, each piston may have a rod having a diameter, the diameter of the rod being between 3.50 mm (i.e. 0.118") and 4.00 mm (i.e. 0.158")—including upper and lower limits.

The rod may comprise a stem and an eye. The rod may be the diameter of the stem.

According to aspects of the present disclosure, the first diameter may be between 150 mm (i.e. 6") and 260 mm (i.e. 10")—including upper and lower limits—and the second diameter may be between 230 mm (i.e. 9") and 390 mm (i.e. 15")—including upper and lower limits.

According to aspects of the present disclosure, the auto-retraction mechanism may comprise an even number of pistons, the pistons are grouped in pairs, each pair of pistons is regularly distributed about the axis, and the pistons of each pair of pistons are coupled to a same coupling element and extend circumferentially on opposite sides of the coupling element.

According to aspects of the present disclosure, the auto-retraction mechanism may comprise four pistons or eight pistons.

According to aspects of the present disclosure, the downhole packer assembly may comprise two auto-retraction mechanisms disposed on opposite axial sides of the inflatable bladder.

In the manner described and according to aspects illustrated herein, the auto-retraction mechanism may help to secure the downhole packer assembly in the deflated configuration when the inflatable bladder is not inflated, and may assist the transition of the downhole packer assembly from the expanded configuration to the deflated configuration. The pistons being mounted onto the chassis, the forces may be well balanced and distributed, enabling the pistons to exert relatively high forces on the coupling element, capable of remove (or release or unstick) the outer wall from the borehole, without causing damages or severe deformations.

BRIEF DESCRIPTION OF THE DRAWINGS

The disclosure and its advantages can be better understood by reading the detailed description of various embodiments given as non-limiting examples. The description refers to the accompanying sheets of figures, in which.

DETAILED DESCRIPTION

Figure 1:
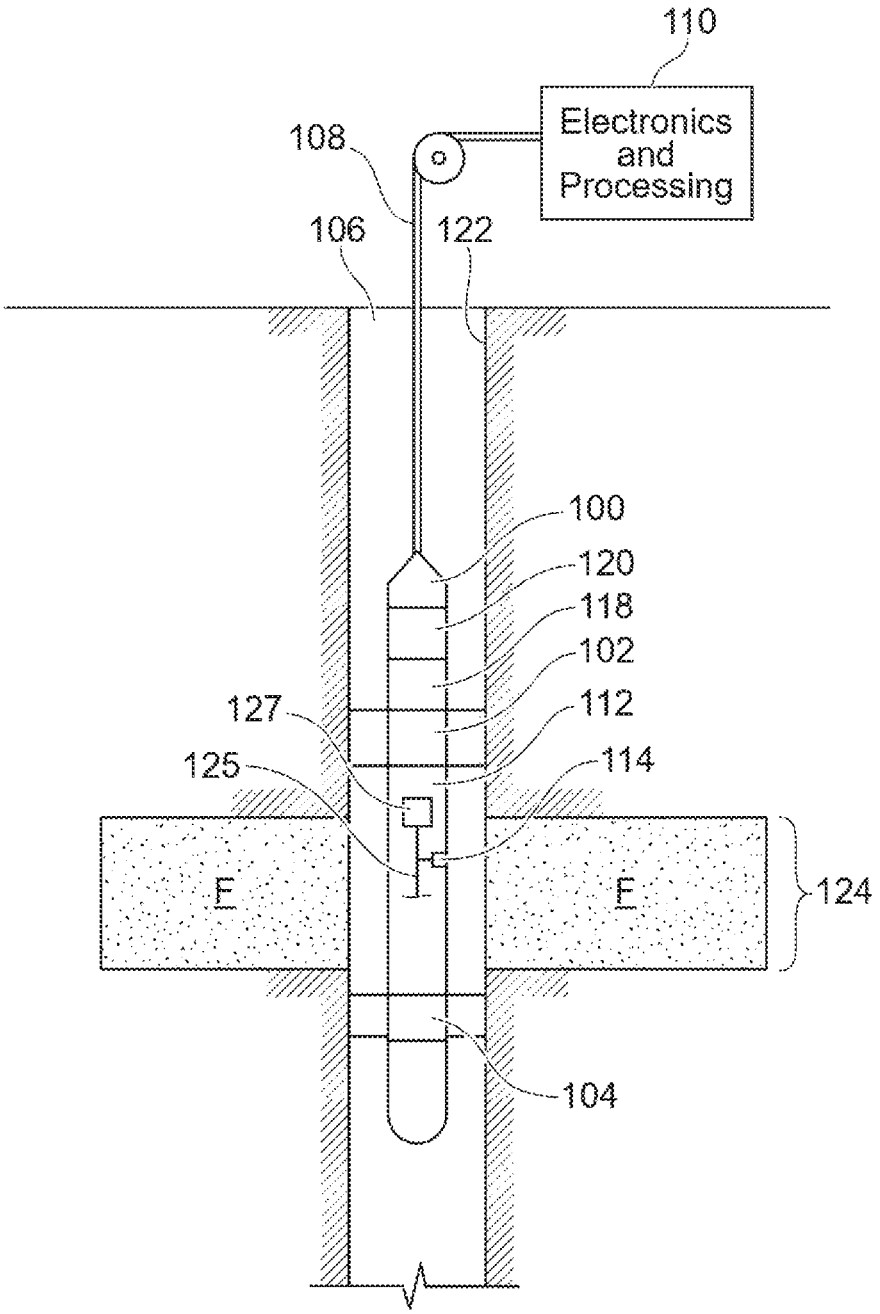
FIG. 1 (Prior Art)
FIG. 1 shows an example of a downhole tool employing known inflatable packer assemblies.
Figure 2:
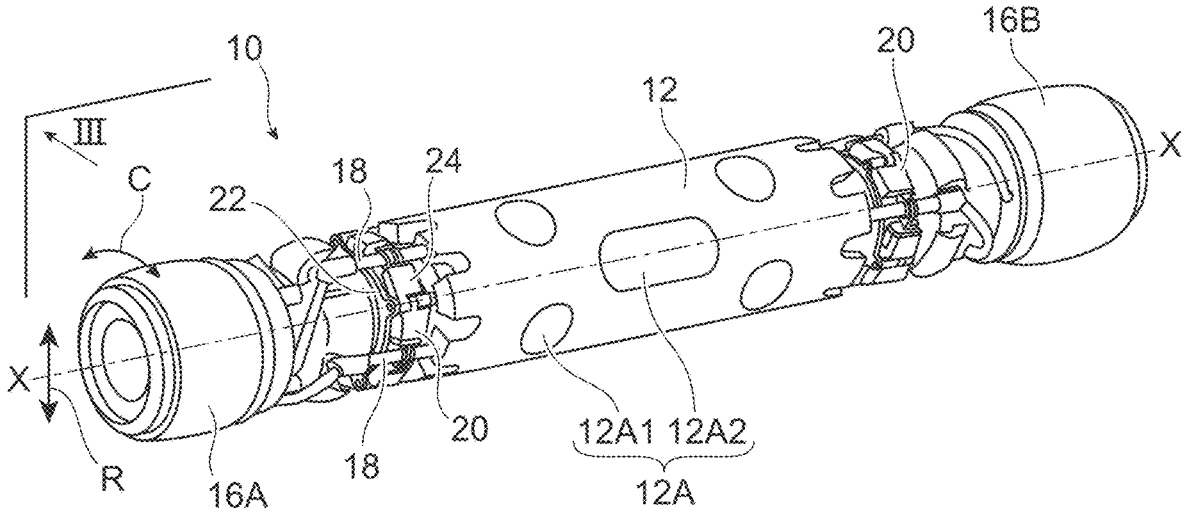
FIG. 2 shows a downhole packer assembly according to the present disclosure.

A downhole packer assembly according to aspects of the present disclosure is described with reference to FIGS. 1 to 10, wherein like numerals represent like parts. Although the downhole packer assembly is described with reference to specific examples, it should be understood that modifications and changes may be made to these examples without going beyond the general scope as defined by the claims. In particular, individual characteristics of the various examples shown and/or mentioned herein may be combined in additional examples. Consequently, the description and the drawings should be considered in a sense that is illustrative rather than restrictive. The Figures, which are not necessarily to scale, depict illustrative aspects and are not intended to limit the scope of the disclosure. The illustrative aspects depicted are intended only as exemplary.

The term "exemplary" is used in the sense of "example," rather than "ideal." While aspects of the disclosure are amenable to various modifications and alternative forms, specifics thereof have been shown by way of example in the drawings and will be described in detail. It should be understood, however, that the intention is not to limit aspects of the disclosure to a particular example described. On the contrary, the intention of this disclosure is to cover all modifications, equivalents, and alternatives falling within the scope of the disclosure.

Various materials, methods of construction, methods of fastening, and the like may be described in the context of disclosed examples. Those skilled in the art will recognize known substitutes for the materials, construction methods, fastening methods, and the like, all of which are contemplated as compatible with the disclosed example and are intended to be encompassed by the appended claims.

As used in this disclosure and the appended claims, the singular forms "a," "an," and "the" include plural referents, unless the content clearly dictates otherwise. As used in this disclosure and the appended claims, the term "or" is generally employed in a sense including "and/or," unless the content clearly dictates otherwise.

Throughout the description, including the claims, the terms "comprising a," "including a," and "having a" should be understood as being synonymous with "comprising one or more," "including one or more," and "having one or more" unless otherwise stated. In addition, any range set forth in the description, including the claims, should be understood as including its end value(s), unless otherwise stated. Specific values for described elements should be understood to be within accepted manufacturing or industry tolerances known to one of skill in the art, and any use of the terms "substantially," "approximately," and "generally" should be understood to mean falling within such accepted tolerances.

When an element or feature is referred to herein as being "on," "engaged to," "connected to," or "coupled to" another element or feature, it may be directly on, engaged, connected, or coupled to the other element or feature, or intervening elements or features may be present. In contrast, when an element or feature is referred to as being "directly on," "directly engaged to," "directly connected to," or "directly coupled to" another element or feature, there may be no intervening elements or features present. Other words used to describe the relationship between elements or features should be interpreted in a like manner (e.g. "between" versus "directly between," "adjacent" versus "directly adjacent," etc.).

Spatially relative terms, such as "top," "bottom," "middle," "inner," "outer," "beneath," "below," "lower," "above," "upper," and the like may be used herein for ease of description to describe one element or relationship of a feature to another element(s) or feature(s) as illustrated in the drawings. Spatially relative terms may be intended to encompass different orientations of a device in use or operation in addition to the orientation depicted in the drawings. For example, if the device in the drawings is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Although the terms "first," "second," "third," etc. may be used herein to describe various elements, components, regions, layers, sections, and/or parameters, these elements, components, regions, layers, sections, and/or parameters should not be limited by these terms. These terms are only used to distinguish one element, component, region, layer, section, or parameter from another element, component, region, layer, section, or parameter. Thus, a first element, component, region, layer, section, or parameter discussed herein could be termed a second element, component, region, layer, section, or parameter without departing from the teachings of the present disclosure.

The example downhole packer assembly described herein may be used to sample fluids in a subterranean formation. The example downhole packer assembly described herein may have an inflatable bladder and an outer wall for expanding in and/or engaging with walls in a wellbore. The downhole packer assembly may have several components for reinforcing and/or stabilizing the expansion of the inflatable bladder and/or the outer wall.

FIG. 1 depicts an example of a downhole tool 100 employing known packer assemblies 102, 104. The example downhole tool 100 is depicted as being deployed (e.g. lowered) into a wellbore or borehole 106 to sample a fluid from a subterranean formation F. The downhole tool 100 is depicted as a wireline type tool that may be lowered into the borehole 106 via a cable 108. The cable 108 bears the weight of the downhole tool 100 and may include electrical wires or additional cables to convey power, control signals, information carrying signals, etc. between the tool 100 and an electronics and processing unit 110 on the surface adjacent to the borehole 106. While the example downhole tool 100 is depicted as being deployed in the borehole 106 as a wireline device, the tool 100 may alternatively or additionally be deployed in a drill string, using coiled tubing, or by any other known method of deploying a tool into a borehole.

The downhole tool 100 includes a sampling module 112 having a sampling inlet 114. The sampling module 112 may further include an extendable probe (not shown) associated with the inlet 114 and an extendable anchoring member (not shown) to anchor the tool 100 and the probe in position to contact the formation F. The inlet 114, as shown, is a single inlet. However, a second or additional inlets (not shown) may operate in conjunction with the inlet 114 to facilitate dual inlet (i.e. guard) sampling. To extract borehole fluid from the area to be isolated by one or both of the packers 102, 104, the tool 100 includes a pumping module 118. The pumping module 118 may include one or more pumps, hydraulic motors, electric motors, valves, flowlines, etc. to enable borehole fluid to be removed from a selected area of the borehole 106.

To convey power, communication signals, control signals, etc. between the surface (e.g. to/from the electronics and processing unit 110) and among the various sections or modules composing the downhole tool 100, the tool 100 includes an electronics module 120. The electronics module 120 may, for example, be used to control the operation of the pumping module 118 in conjunction with operation of the packers 102, 104. For example, the packers 102, 104 may be used to hydraulically isolate a portion of the borehole 106 to facilitate sampling or testing a portion of the formation F.

In operation, the downhole tool 100 may be lowered via the cable 108 into the borehole 106 to a depth that aligns the sampling module 112 and, particularly, the sampling inlet 114, with a portion of the formation F to be sampled. The pumping module 118 may then be used to pump pressurized borehole fluid into the packers 102, 104 to inflate the packers 102, 104 so that the outer circumferential surfaces of the packers 102, 104 sealingly engage a wall 122 of the borehole 106. With the packers 102, 104 inflated, an area or section 124 of the borehole 106 between the packers 102, 104 is hydraulically isolated from the remainder of the borehole 106. The area 124 may be referred to as the interval, and the fluid contained therein may be at an interval pressure. The pumping module 118 is then used (e g. controlled by the electronics module 120 and/or the electronics and processing unit 110) to pump borehole fluid from the area 124 of the borehole 106. The pumping module 118 is then used to pump formation fluid from the formation F via the inlet 114 and a flowline 125 into a sample chamber 127 within the tool 100. The sample chamber 127 may not be located in the sampling module 112 as shown but may, for example, be located in its own sample module (not shown).

Following collection of a sample, the pressurized fluid within the packers 102, 104 is released (e.g. by the pumping module 118) into the borehole 106 outside of the area 124. However, even if the packers 102, 104 are deflated or the pressurized fluid within the packers 102, 104 is released, the packers 102, 104 may stick to the wall 122 of the borehole 106 or may maintain a relatively large outer diameter (i.e. not fully contract to their pre-inflation diameters), particularly if the borehole 106 has a relatively high temperature. If the outer diameter of one or both of the packers 102, 104 is not reduced to less than the minimum diameter of the borehole 106, then withdrawal of the tool 100 from the borehole 106 may be difficult or impossible without significant damage to the tool 100 and/or the borehole 106.

An example of a downhole packer assembly 10 is described with reference to FIGS. 2 to 8. The downhole packer assembly 10 has an axis X. Reference signs R and C respectively represent a radial direction and a circumferential direction.

The downhole packer assembly 10 may comprise an outer wall 12 having at least one drain 12A.

In the present example, the downhole packer assembly 10 may comprise twelve drains 12A, for example, eight drains 12A1 of a first type and four drains 12A2 of a second type. The downhole packer assembly 10 may comprise two sets of four drains 12A1 and one set of four drains 12A2. The set of drains 12A2 may be axially disposed between the two sets of drains 12A1. The drains 12A1 of the two sets of drains 12A1 may be aligned in pairs in the circumferential direction C, and the drains 12A1 of each set of drains 12A1 may be regularly distributed about the axis X (i.e. in the circumferential direction C). The drains 12A2 may be regularly distributed about the axis X, and may be shifted relative to the drains 12A1. For example, considered in the circumferential direction C the drains 12A2 are disposed between two adjacent drains 12A1, for example in the middle of two adjacent drains 12A1.

Figure 3:
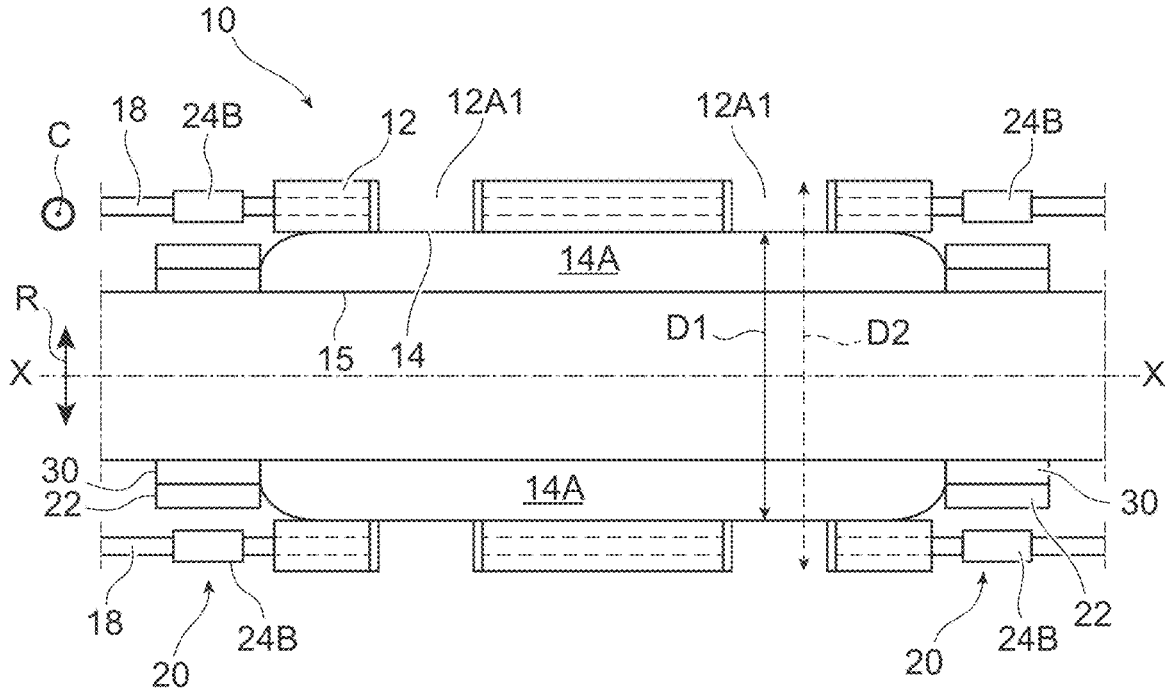
FIG. 3 shows a partial cross section view in plane III of FIG. 2.
Figure 4:
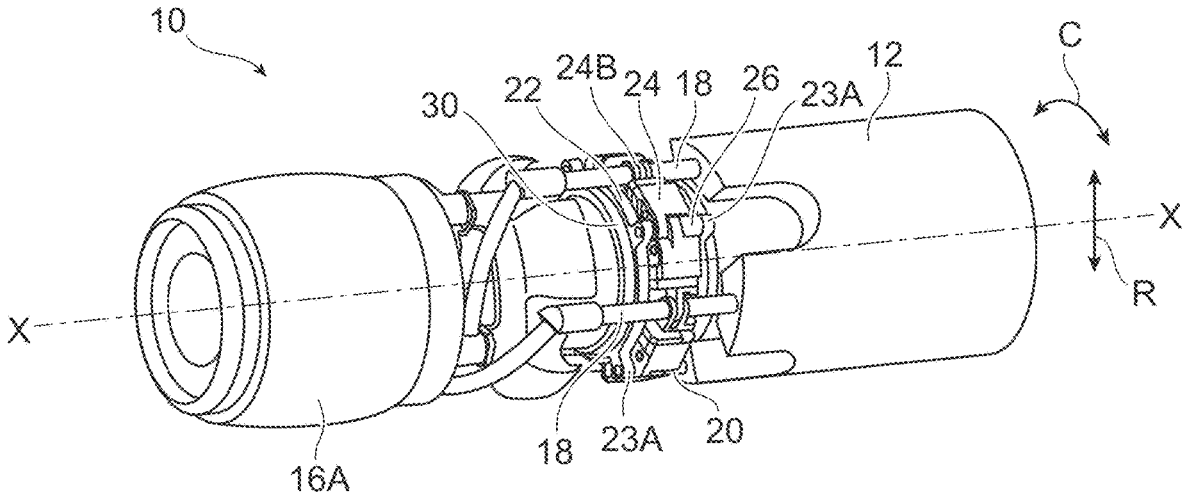
FIG. 4 shows a detailed view of an axial end of the downhole packer assembly of FIG. 2, in the deflated configuration.
Figure 5:
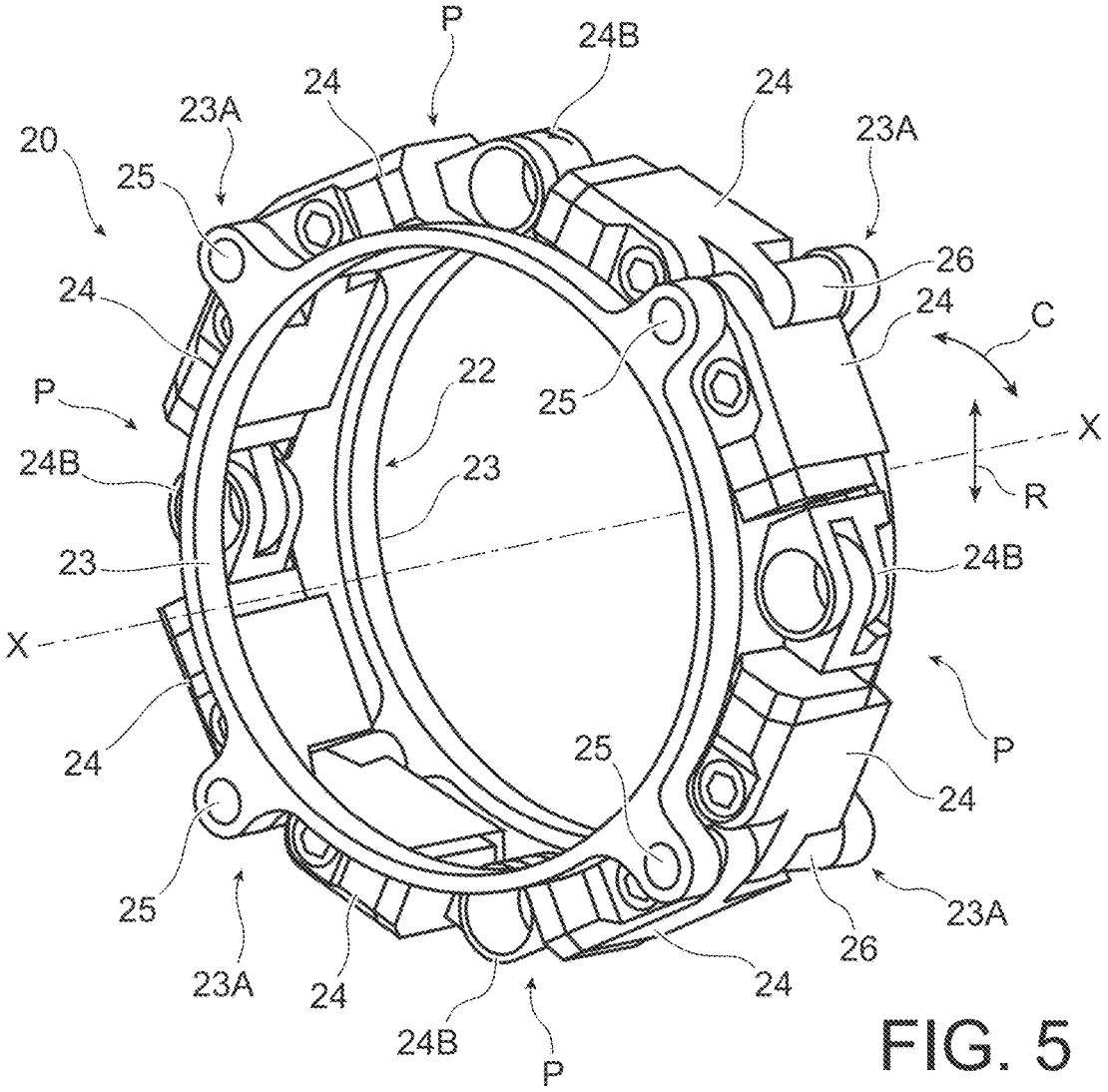
FIG. 5 shows one auto-retraction mechanism of the downhole packer assembly of FIG. 2, when the downhole packer assembly is in the deflated configuration.

The downhole packer assembly 10 may comprise an inflatable bladder 14 configured to cause the outer wall 12 to expand radially outwardly, the inflatable bladder 14 having a first diameter D1 in a deflated configuration (see FIGS. 2, 3 and 4) and a second diameter D2 in an inflated configuration (see FIG. 7), the second diameter D2 being greater than the first diameter D1. The first and second diameters D1 and D2 are shown in FIG. 3, the second diameter D2 being shown in dashed line. The first diameter D1 may be between 150 mm (i.e. 6") and 260 mm (i.e. 10") and the second diameter D2 may be between 220 mm and 390 mm (i.e. 15").

In the present example, the outer wall 12 may be distinct from the inflatable bladder 14. The outer wall 12 and the inflatable bladder 14 may directly cooperate with each other, for example the outer wall 12 and the inflatable bladder 14 may bear against each other. The outer wall 12 may form an outer sleeve or an outer sheath wrapping all or part of the inflatable bladder 14. The outer wall 12 and the inflatable bladder 14 may be coaxial, and the inflatable bladder 14 may extend radially inside the outer wall 12.

The downhole packer assembly 10 may comprise two end pieces 16A and 16B defining two axially opposed ends of the downhole packer assembly 10, the outer wall 12 and the inflatable bladder 14 being disposed axially between the two end pieces 16A and 16B.

End pieces 16A and 16B may be configured to engage adjacent equipment, for example any tool, tube, pipe, connection, etc., for example any module such as shown in FIG. 1. End pieces 16A, 16B may serve as interface between adjacent equipment connected to the downhole packer assembly 10, and different elements of the downhole packer assembly 10.

The downhole packer assembly 10 may comprise at least one flowline 18 in fluid communication with the at least one drain 12A and with at least one of the end pieces 16A, 16B, the at least one flowline 18 being mechanically coupled radially with the outer wall 12. For example, the downhole packer assembly 10 may comprise four flowlines 18, which may be regularly distributed about the axis X. Each flowline 18 may be circumferentially aligned with one drain 12A1 of the two sets of drains 12A1. For example, the flowlines 18 may be in fluid communication with the drains 12A1 only. As shown in FIG. 3, the flowlines 18 may be embedded within the outer wall 12 and may directly axially open within drains 12A1. As shown in FIG. 3, the flowlines 18 may be in fluid communication with the two end pieces 16A, 16B. Flowlines 18 form an example of coupling elements mechanically coupled radially with the outer wall 12.

The downhole packer assembly 10 may comprise at least one auto-retraction mechanism 20 configured to mechanically assist the outer wall 12 to retract radially inwardly when the inflatable bladder 14 is deflated from the inflated configuration toward the deflated configuration, the auto-retraction mechanism 20 comprising a chassis 22 and a plurality of pistons 24, each piston 24 having one end 24A coupled to the chassis 22 and another end 24B coupled to a coupling element 18.

For example, the downhole packer assembly 10 may comprise two auto-retraction mechanisms 20, disposed on opposite axial sides of the inflatable bladder 14. In the example of FIGS. 2 to 8, the auto-retraction mechanism may comprise eight pistons 24. For example, an auto-retraction mechanism 20 may be axially disposed between the end piece 16A and the outer wall 12 and the other auto-retraction mechanism 20 may be axially disposed between the end piece 16B and the outer wall 12.

For example, each end 24A and 24B of each piston 24 may be coupled via a pivot connection to the chassis 22 and to a coupling element 18, respectively. For example, each end 24A and 24B may comprise an eye, the eye of the end 24A may receive (or may be fitted with) a clevis pin 25 and the eye of the end 24B may receive (or may be fitted with) a coupling element 18.

For example, the downhole packer assembly 10 may comprise two axially opposed mandrels 30 defining axial ends of an inner chamber 14A of the inflatable bladder 14, the chassis 22 of the auto-retraction mechanism 20 surrounding one mandrel 30 of the axially opposed mandrels 30 radially and being mechanically uncoupled with said mandrel 30.

For example, the inner chamber 14A may have an annular shape extending along the axis X. For example, the inner chamber 14A may be axially delimited by the mandrels 30, may be radially outwardly delimited by the inflatable bladder 14, and may be radially inwardly delimited by an inner wall 15. The inner wall 15 may be considered as rigid and non-deformable (i.e. dimensionally stable) in comparison with the inflatable bladder 14 and the outer wall 12. The mandrels 30 may be considered as rigid and non-deformable (i.e. dimensionally stable) in comparison with the inflatable bladder 14 and the outer wall 12. In some cases, depending on a nomenclature point of view, the skilled person may consider that the ensemble comprising the inflatable bladder 14, the inner wall 15 and the two mandrels 30 may form as such an inflatable bladder/inflatable bladder assembly.

The inner chamber 14A may be filled with pressurized borehole fluid to cause the inflatable bladder 14 to expand and/or press against an outer wall 12. As a consequence, the outer wall 12 may be caused to expand and sealingly engage a borehole wall. The outer wall 12 may have an elastomeric material to form an outer layer thereof (not shown). The outer wall 12 may include reinforcing cables or slats (not shown) to strengthen the outer wall 12 and to facilitate the return of the outer wall 12 to its original (i.e. pre-inflation) shape.

Both the chassis 22 and the mandrel 30 may have a cylindrical shape, and the chassis 22 may be axially fitted around the mandrel 30 and may remain free to rotate and to slide along the axis X with respect to the mandrel 30.

For example, the chassis 22 may comprise at least one ring 23 provided with a plurality of clevises 23A, each clevis 23A being coupled to at least one piston 24.

In the example of FIGS. 2 to 8, the chassis 22 may comprise two rings 23, and each ring 23 may be provided with a single eye 23AA of each clevis 23A. The two rings 23 may be axially coupled via the clevis pins 25. For example, the clevis pins 25 may be crimped or punched within the clevises 23A. The chassis 22 may comprise four clevises 23A. The clevises 23A may be regularly distributed about the axis X. Considered in the circumferential direction C, each coupling element 18 may be disposed between two adjacent clevises 23A.

For example, two pistons 24 may be coupled to each clevis 23A. For example, the auto-retraction mechanism 20 may comprise an even number of pistons 24, the pistons 24 may be grouped in pairs P, each pair P of pistons 24 may be regularly distributed about the axis X, and the pistons 24 of each pair P of pistons 24 are coupled to a same coupling element 18 and extend circumferentially on opposite sides of the coupling element 18. The two pistons 24 of each pair P of pistons 24 may be coupled to two different and adjacent clevises 23A. In other words, each pair P of pistons 24 extend between two adjacent clevises 23A. In the example of FIGS. 2 to 8, each clevis 23A may carry two pistons 24 of two adjacent pairs P of pistons 24. Considered along the axis X, the eyes of the ends 24A of the two pistons 24 mounted to a single clevis 23A may be staggered. An additional washer 26 may be provided and fitted on the clevis pin 25 to prevent any axial clearance and/or axial movement of the pistons 24 relative to the chassis 22.

Figure 6A:
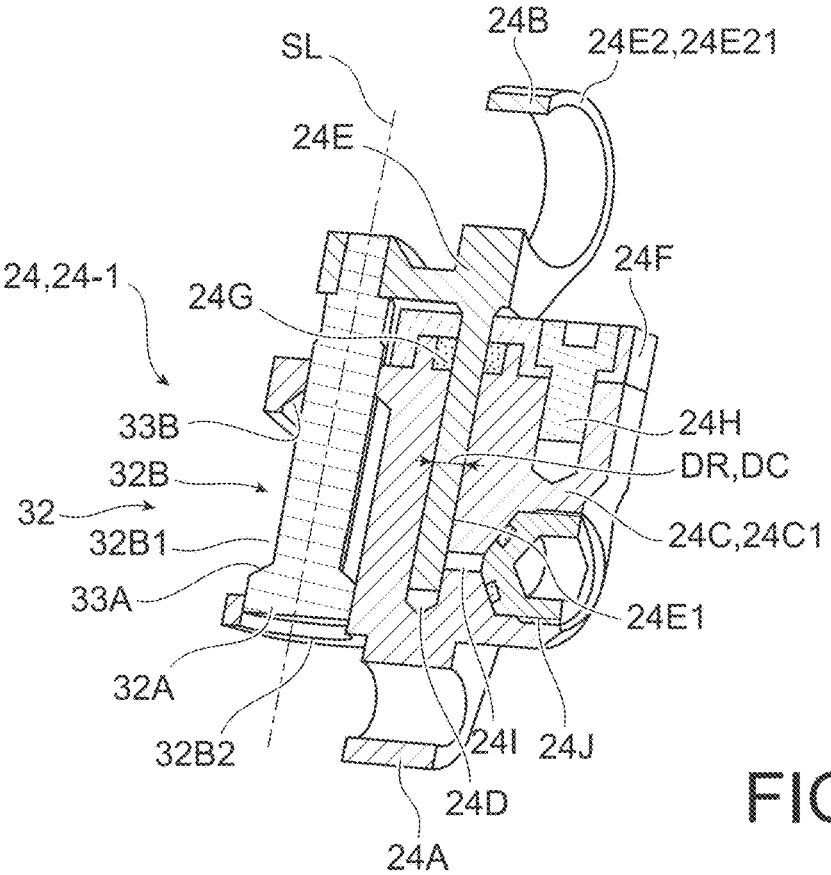
FIGS. 6A and 6B show cross section views of two pistons of a pair of pistons of the auto-retraction mechanisms of the downhole packer assembly of FIG. 2.
Figure 6B:
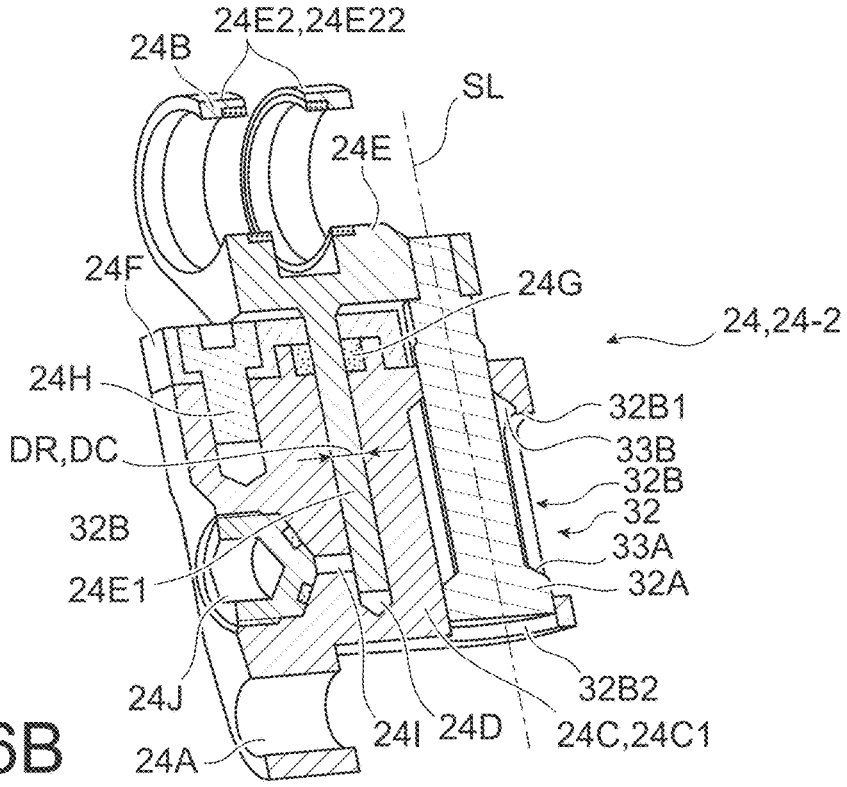
Figure 7:
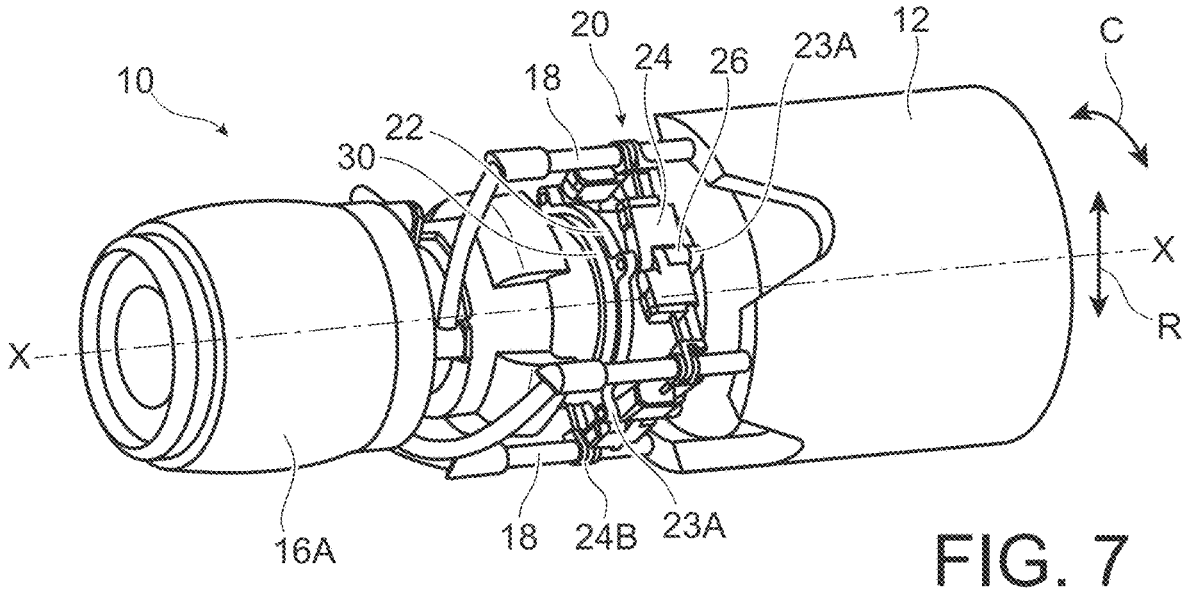
FIG. 7 shows the detailed view of the axial end of the downhole packer assembly of FIG. 2, in the inflated configuration.
Figure 8:
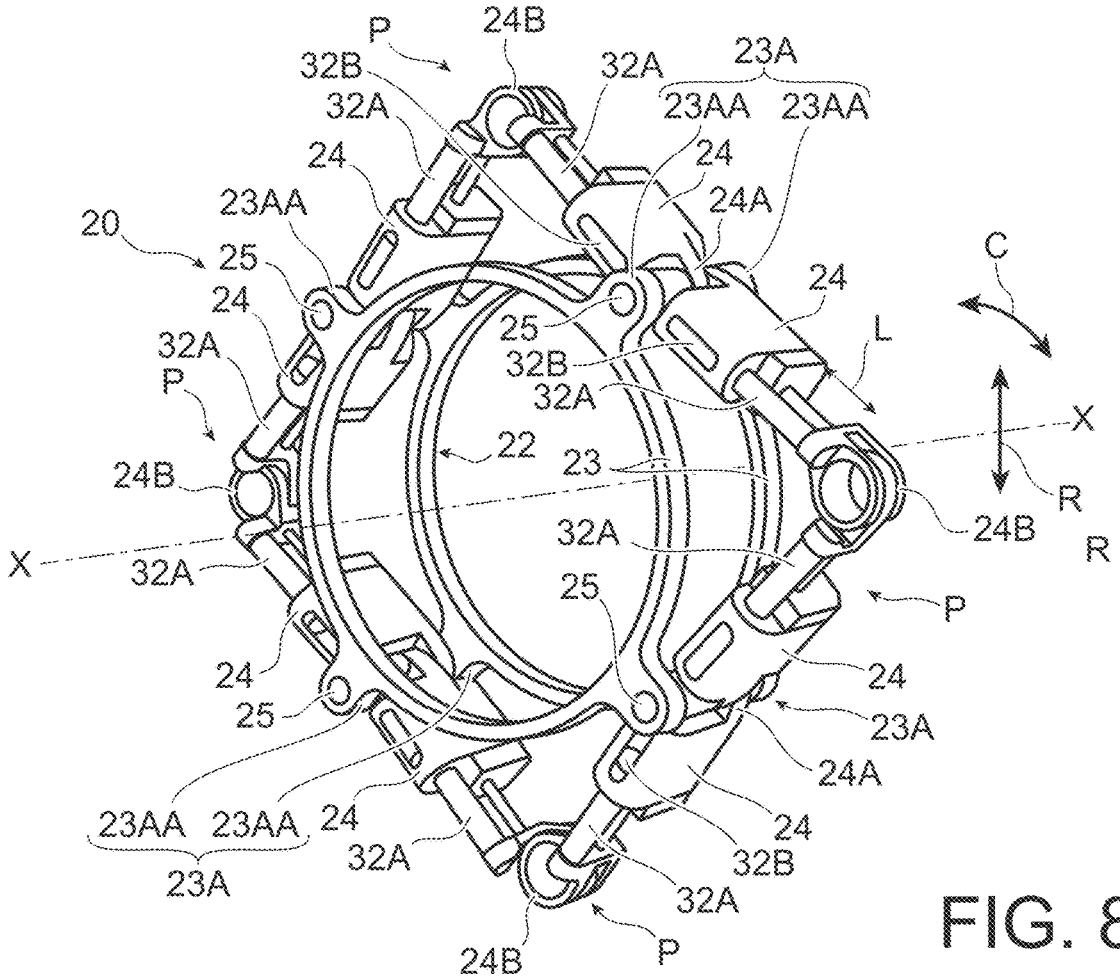
FIG. 8 shows one auto-retraction mechanism of the downhole packer assembly of FIG. 2, when the downhole packer assembly is in the inflated configuration.

FIGS. 6A and 6B show two pistons 24 of a pair P of pistons 24 with more details. A first piston 24-1 among the two pistons 24 of the pair P and a second piston 24-2 among the two pistons 24 of the pair P may be similar, except the position of the eyes of the ends 24A and 24B, to allow mounting of several pistons 24 on a same clevis pin 25 or on a same coupling element 18.

Each piston 24 may comprise a cylinder 24C having a chamber 24D and a rod 24E slidingly received within the chamber 24D and configured to move between an extended position (see FIGS. 7 and 8) and a retracted position (see FIGS. 4, 5, 6A and 6B). The rod 24E may comprise a stem 24E1 and an eye 24E2.

In the present example, the rod 24E of the piston 24-1 may comprise a single eye 24E21 while the rod 24E of the piston 24-2 may comprise two eyes 24E22. The eye 24E21 may be configured to be received between the two eyes 24E22 when the two pistons 24-1 and 24-2 of the pair P are mounted on a same coupling element 18, as shown for example on FIGS. 4, 5, 7 and 8. The stem 24E1 may have a regular shape and a constant diameter along its length. The rod 24E, for example the stem 24E1, may have a diameter DR substantially equal to a diameter DC of the chamber 24D. This may help to ensure an appropriate guiding of the sliding movement of the rod 24E between the retracted and extended position. The diameter of the rod 24E, for example the diameter of the stem 24E1, may be between 3.50 mm (i.e. 0.118") and 4.00 mm (i.e. 0.158").

In the present example, the eye of the end 24A of each piston 24-1 and 24-2 may be similar, and staggered relative to each other to allow a mounting of two pistons 24-1 and 24-2 on a same clevis pin 25, as shown for example on FIGS. 4, 5, 7 and 8, optionally with a washer 26. Such a washer 26 may substantially have the same length as a stop mechanism described hereunder, considered along the clevis pin 25.

The cylinder 24C may comprise a cylinder body 24C1 and a cap 24F tightly sealing the chamber 24D. A gasket 24G may help to ensure sealing of the chamber 24D, in particular between the cap 24F and the rod 24E. The cap may be mounted onto the cylinder body 24C1 with the help of a screw 24H.

Each piston 24 may be a passive piston and the chamber 24D may be pressurized at an atmospheric pressure when the rod 24E is in the retracted position. For example, the chamber 24D may be in fluid communication with the outside of the cylinder 24C via an opening 241, which may be tightly closed with a screw 24J. The opening 241 may open laterally relative to the axis of the rod 24E. This may help to pressurise the chamber when the downhole packer assembly 10 is out of the wellbore or borehole, i.e. in an environment at the atmospheric pressure.

Each piston 24 may comprise a stop mechanism 32 configured to limit extension of the rod 24E to a predetermined length L in the extended position (see FIG. 8), the stop mechanism 32 comprising a sliding shaft 32A received within an open sliding path 32B arranged outside the chamber 24D of the cylinder 24C.

The sliding shaft 32A may be mounted, for example screwed, to the rod 24E, and may be configured to move simultaneously and in the same direction with the rod 24E.

The open sliding path 32B may be arranged in the cylinder body 24C1. The open sliding path 32B may have a lateral opening 32B1, which may have an oblong shape extending parallel to the sliding shaft 32A. The open sliding path 32B may have an end opening 32B2, which may open on the side of the end 24A of the piston 24. The lateral opening 32B1 and/or the end opening 32B2 may help to prevent foreign element(s) such as sand, rubble, stone(s) or the like obstructing or blocking the sliding movement of the shaft 32A while presenting a simple and robust structure.

The sliding shaft 32A and the open sliding path 32B have complementary abutment surfaces 33A, 33B configured to abut against each other in a sliding direction SL of the sliding shaft 32A, the abutment surfaces 33A, 33B being bevelled with respect to the sliding direction SL of the sliding shaft 32A. The abutment surfaces 33A, 33B may be configured to cooperate in a form-fitting manner. This may help to expel potential foreign element(s) out of the open sliding path 32B via the lateral opening 32B1 when the sliding shaft 32A reach its extended position and the complementary abutment surfaces 33A, 33B engage with each other.

When used and inserted within a wellbore or borehole, the downhole packer assembly 10 is in the deflated configuration and the pistons 24 in the retracted position. When the downhole packer assembly 10 has reached a working depth, the local pressure around the downhole packer assembly 10 may usually be very high, for example between 5,000 Psi (i.e. 34.5 MPa) and 35,000 Psi (i.e. 241 MPa). The pressure within the pistons 24, at the retracted position, being at the atmospheric pressure, i.e. much lower than the pressure outside the downhole packer assembly 10 and the pistons 24, the rods 24E are maintained in their retracted position and blocked in position within the chamber 24D by suction effect. In such a manner, the auto-retraction mechanism 20 may help to secure the downhole packer assembly 10 in the deflated configuration when the inflatable bladder 14 is not inflated. When the inflatable bladder 14 is pressurized, for example with the help of a pump such as the pumping module 118 of FIG. 1, the downhole packer assembly 10 may transition from the deflated to the inflated configuration. In such a transition, the rods 24E may be pulled out of the chambers 24D of the pistons 24, and may be tensioned or energized. The chassis 22 may help to distribute and balance the forces and the auto-retraction mechanism 20 may withstand a large tensioning or energizing. When the pressure within the inflatable bladder 14 is released, for example when sampling operations are completed, the pistons 24 may act as return springs and the rods 24E may tend to move from their extended position to their retracted position. The auto-retraction mechanism 20 may assist the outer wall 12 to retract radially inwardly and may help the downhole packer assembly 10 to transit from the inflated configuration to the deflated configuration. The auto-retraction mechanism 20 may provide enough forces to remove the outer wall 12 from a wall of the wellbore or borehole, even in sticky conditions.

Figure 9:
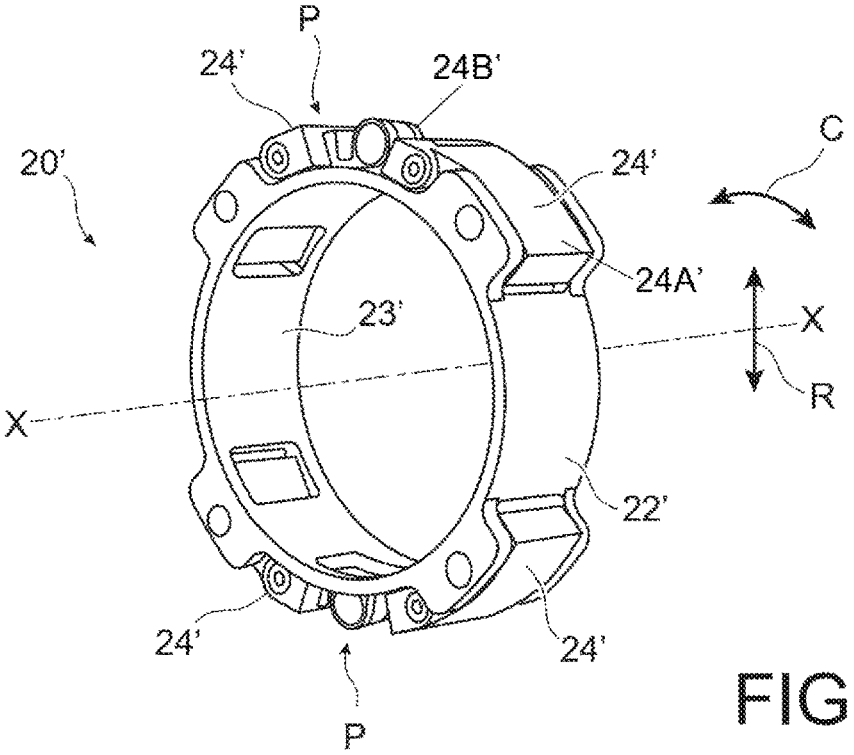
FIG. 9 shows a variant of an auto-retraction mechanism, when the downhole packer assembly is in the deflated configuration.
Figure 10:
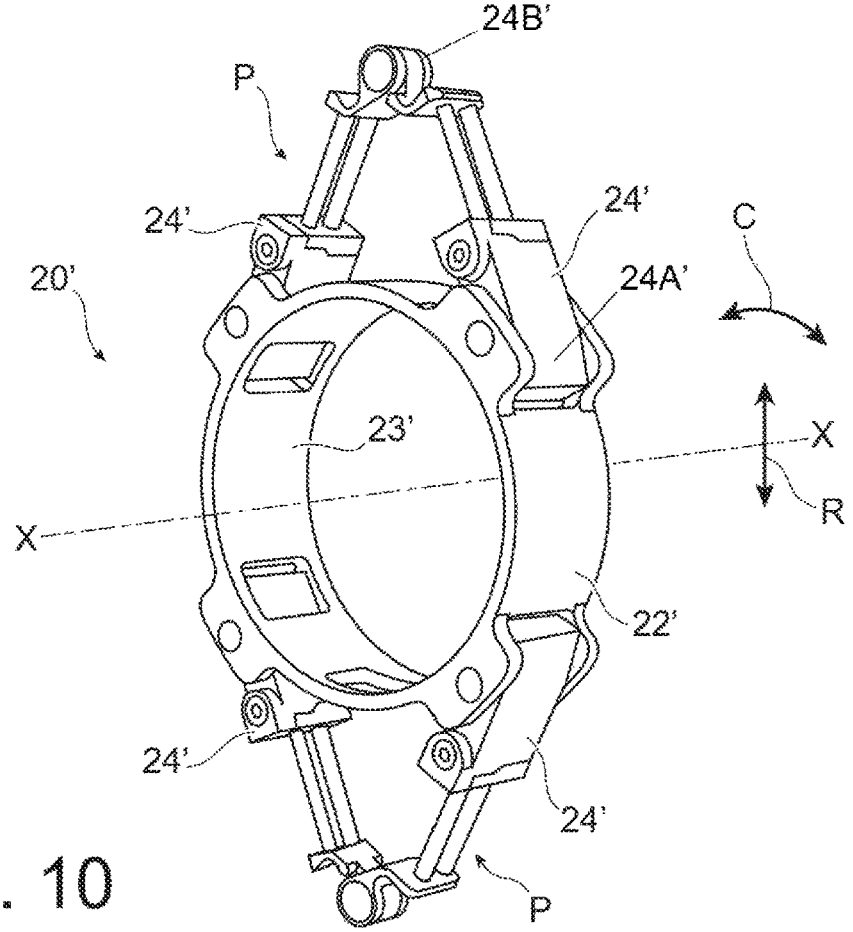
FIG. 10 shows the variant of FIG. 9, when the downhole packer assembly is in the inflated configuration.

FIGS. 9 and 10 show a variant 20' of the auto-retraction mechanism 20 of FIGS. 2 to 8. The main differences between the auto-retraction mechanism 20 and the auto-retraction mechanism 20' are that the chassis 22' of the auto-retraction mechanism 20' may comprise a single ring 23' instead of two rings 23, and that the auto-retraction mechanism 20' may comprise four pistons 24', in the present example two pairs P of pistons 24' regularly distributed about the axis X, instead of eight pistons 24. The shape of the ends 24A' and 24B' of the pistons 24' and of the eyes may differ from the shape of the ends 24A and 24B of the pistons 24. The operating principle of the auto-retraction mechanism 20' may be similar to the one of the auto-retraction mechanism 20. Taking into account the noted differences, the description in relation to the auto-retraction mechanism 20 may apply to the auto-retraction mechanism 20'.

Although the present disclosure is described with reference to specific examples, it is to be understood that these examples are merely illustrative of the principles and applications of the present disclosure. In particular, individual characteristics of the various embodiments shown and/or mentioned may be combined in additional embodiments. Consequently, the description and the drawings should be considered in a sense that is illustrative rather than restrictive.

Additionally, all of the disclosed features of an apparatus may be transposed, alone or in combination, to a method and vice versa.

It is intended that the specification and the examples be considered as exemplary only, with a true scope of the invention being indicated by the following claims.

What is claimed is:

1. A downhole packer assembly having an axis and comprising:

an outer wall;

an inflatable bladder configured to cause the outer wall to expand radially outwardly, the inflatable bladder having a first diameter in a deflated configuration and a second diameter in an inflated configuration, the second diameter being greater than the first diameter;

at least one coupling element mechanically coupled radially with the outer wall; and at least one auto-retraction mechanism configured to mechanically assist the outer wall to retract radially inwardly when the inflatable bladder is deflated from the inflated configuration toward the deflated configuration, the auto-retraction mechanism comprising a chassis and a plurality of pistons, each piston having one end coupled to the chassis and another end coupled to a coupling element of the at least one coupling element.

2. The downhole packer assembly according to claim 1, wherein the outer wall has at least one drain, the downhole packer assembly comprising two end pieces defining two axially opposed ends of the downhole packer assembly, the outer wall and the inflatable bladder being disposed axially between the two end pieces; and at least one of the at least one coupling element being a flowline in fluid communication with the at least one drain and with at least one of the end pieces.

3. The downhole packer assembly according to claim 1, comprising two axially opposed mandrels defining axial ends of an inner chamber of the inflatable bladder, the chassis of the auto-retraction mechanism surrounding one mandrel of the axially opposed mandrels radially and being mechanically uncoupled with the one mandrel.

4. The downhole packer assembly according to claim 1, wherein the chassis comprises at least one ring provided with a plurality of clevises, each clevis being coupled to at least one piston of the plurality of pistons.

5. The downhole packer assembly according to claim 1, wherein each piston comprises a cylinder having a chamber and a rod slidingly received within the chamber and configured to move between an extended position and a retracted position, the rod having a diameter substantially equal to a diameter of the chamber.

6. The downhole packer assembly according to claim 1, wherein each piston comprises a cylinder having a chamber, a rod slidingly received within the chamber and configured to move between an extended position and a retracted position, and a stop mechanism configured to limit extension of the rod to a predetermined length in the extended position, the stop mechanism comprising a sliding shaft received within an open sliding path arranged outside the chamber of the cylinder.

7. The downhole packer assembly according to claim 6, wherein the sliding shaft and the open sliding path have complementary abutment surfaces configured to abut against each other in a sliding direction of the sliding shaft, the abutment surfaces being bevelled with respect to the sliding direction of the sliding shaft.

8. The downhole packer assembly according to claim 1, wherein each piston is a passive piston comprising a cylinder having a chamber and a rod slidingly received within the chamber and configured to move between an extended position and a retracted position, the chamber being pressurized at an atmospheric pressure when the rod is in the retracted position.

9. The downhole packer assembly according to claim 1, wherein each piston has a rod having a diameter, the diameter of the rod being between 3.50 mm and 4.00 mm.

10. The downhole packer assembly according to claim 1, wherein the first diameter is between 150 mm and 260 mm and the second diameter is between 220 mm and 390 mm.

11. The downhole packer assembly according to claim 1, wherein the auto-retraction mechanism comprises an even number of pistons, the pistons are grouped in pairs, each pair of pistons is regularly distributed about the axis, and the pistons of each pair of pistons are coupled to a same coupling element of the at least one coupling element and extend circumferentially on opposite sides of the same coupling element.

12. The downhole packer assembly according to claim 1, wherein the auto-retraction mechanism comprises four pistons or eight pistons.

13. The downhole packer assembly according to claim 1, wherein the at least one auto-retraction mechanism comprises two auto-retraction mechanisms disposed on opposite axial sides of the inflatable bladder.

* * * * *